United States Patent [19]

Bettin

[11] 4,214,446

[45] Jul. 29, 1980

[54] PRESSURE-FLOW COMPENSATED HYDRAULIC PRIORITY SYSTEM PROVIDING SIGNALS CONTROLLING PRIORITY VALVE

[75] Inventor: Leonard A. Bettin, Lyons, Ill.

[73] Assignee: International Harvester Company, Chicago, Ill.

[21] Appl. No.: 5,048

[22] Filed: Jan. 22, 1979

[51] Int. Cl.[2] ..... F15B 11/16

[52] U.S. Cl. ..... 60/420; 60/422; 60/445; 60/484

[58] Field of Search ..... 60/327, 420, 422, 445, 60/484

[56] References Cited

U.S. PATENT DOCUMENTS

| | | | |
|---|---|---|---|
| 2,445,544 | 7/1948 | Trautman | 137/117 |
| 2,532,552 | 12/1950 | Jirsa et al. | 137/625.68 |
| 2,573,563 | 10/1951 | Gardiner | 60/427 X |
| 2,752,931 | 7/1956 | Schutmaat | 137/80 |
| 2,757,641 | 8/1956 | Meddock | 137/624.27 |
| 2,848,041 | 8/1958 | Hollings et al. | 60/243 |
| 3,098,507 | 7/1963 | Froslie | 137/628 |
| 3,128,677 | 4/1964 | Tennis | 91/383 |
| 3,217,731 | 11/1965 | Swanson | 137/116.3 |
| 3,334,705 | 8/1967 | Lam | 60/422 |
| 3,444,689 | 5/1969 | Budzich | 60/427 |
| 3,465,519 | 9/1969 | McAlvay et al. | 60/422 |
| 3,508,847 | 4/1970 | Martin | 60/445 X |
| 3,597,921 | 8/1971 | McBurnett | 60/386 |
| 3,628,557 | 12/1971 | Newborough | 137/116.3 |
| 3,750,405 | 8/1973 | Lech et al. | 60/422 |
| 3,979,907 | 9/1976 | Paul | 60/422 |
| 3,979,908 | 9/1976 | Alderson | 60/422 |
| 4,089,346 | 5/1978 | Budzich | 137/596.13 |
| 4,107,923 | 8/1978 | Budzich | 60/427 |

OTHER PUBLICATIONS

Cessna Product Education Bulletin No. 27, 8-1-76.
Cessna Specification Sheet No. 32350, 8-1-77.
Load Sensing Systems by Cessna Bulletin P.I., 4/77.

*Primary Examiner*—Edgar W. Geoghegan
*Attorney, Agent, or Firm*—John W. Gaines; Ronald C. Kamp; F. David AuBuchon

[57] ABSTRACT

Priority valve system with pressure-flow compensation and signal control having first, a restricted orifice which can be satisfied when flow requirements therethrough are sufficiently large in combination with, second, a closed center primary control valve equipped with an hydraulic detent unlatch mechanism and hydraulically disposed downstream of the orifice to receive the flow directed thereto by the orifice, all to provide appropriate signals controlling the priority valve.

Through this intervening, novel two component control combination, the priority valve is controlled to supply flow to a priority load and, in addition, has an auxiliary outlet chamber connected to an auxiliary motor with the purpose to cut off the auxiliary chamber flow whenever the priority flow is sufficient to satisfy only the restricted orifice. The primary valve is a center dump valve which, when its unlatch mechanism is automatically tripped by priority-load stall-out, dumps pressure causing the priority valve to reconnect to the auxiliary motor, and also causing a commensurate reduction in output of a pressure-compensated main pump provided for the system.

9 Claims, 6 Drawing Figures

PRESSURE-FLOW COMPENSATED HYDRAULIC PRIORITY SYSTEM PROVIDING SIGNALS CONTROLLING PRIORITY VALVE

This invention involves certain improvements amounting to a significant departure in structure over the structure disclosed in U.S. Pat. No. 3,979,908, the two being related structures.

The invention concerns a known system of pressure-flow compensated hydraulic components, the initial major ones of which consist of a variable displacement, automatically controlled pump for supplying a priority flow path and at least one auxiliary motor; and a priority valve hydraulically disposed in the pump output and provided with an auxiliary outlet chamber for the auxiliary motor and a control servo to cut off the auxiliary flow whenever flow in the priority path is insufficient, the control servo being responsive to a pressure-flow activating signal at a lower stage, high pressure for positioning the priority valve in a first position to cut off the auxiliary flow whenever the priority flow is insufficient, and further responsive to a pressure-flow deactivating signal for positioning the priority valve in a second position opening the auxiliary outlet chamber for any and all flow in excess of what is ample for the priority flow.

The difficulty in the known system resides in another major component, the third one, which is the signal generating, restricted orifice hydraulically disposed between the above priority valve and its priority load. In practice, that orifice is restrictably adjusted so that its flow requirements are satisfied only when the priority flow is ample, whereafter it will signal to deactivate the priority valve and open the auxiliary outlet chamber to receive the excess flow over what is ample for the priority flow. So during priority load stall-out, the flow requirements of the restricted orifice inherently become unsatisfied, and the orifice applies to the priority valve a higher stage, high activating signal cutting off auxiliary flow as well, so that there is no flow whatever in the system.

The referred to U.S. Pat. No. 3,979,908 recognizes the foregoing difficulty, but fails to show or suggest my present specific solution which comes into play entirely automatically, affording a simplified and efficient system performance.

More specificially, I provide a two component combination consisting of a restricted orifice and a detented, hydraulic unlatch, closed center primary valve hydraulically in tandem with one another, connected in that order upstream of the priority load for automatically creating a second pressure-flow deactivating signal for positioning the priority valve in the second position to open the auxiliary outlet chamber to the auxiliary motor even when there is no flow in the priority load because of stall-out.

In brief terms for now, with a fuller explanation to follow hereinafter, the primary valve operates with an hydraulic unlatching, re-switching function so as automatically to reset itself to closed-center neutral position during the higher stage, high pressure occasioned during priority load stall-out, and automatically to disconnect and reconnect the control servo from the high activating signal to a deactivating signal to drain so as to position the priority valve to feed the auxiliary outlet chamber, and automatically for the primary valve as thus reset in its closed-center neutral position to block off both the stalled-out priority load and fluid supply thereto. Finally as part of its re-switching function, the primary valve as thus reset disconnects itself from a compensator-connected line downstream of the primary valve, so as to relinquish all control over the output-controlling compensator of the automatically controlled pump in the system.

My invention can equally well be used in strictly pressure compensation systems or strictly flow compensation systems, or likewise an open center valve system as opposed to the closed center system hereinabove.

In examples of applications of my invention to follow, the invention will be shown as it applies in general to hydraulic equipment on a farm tractor embodying an hydraulic flow circuit which must have priority over other circuit systems whenever the pump output provided cannot supply all of the circuits with their flow requirements at the same time.

Further features, objects, and advantages will either be particularly described or become apparent when, for a better understanding of my invention, reference is made to the following description, taken into conjunction with the accompanying drawings in which certain preferred embodiments thereof are shown and in which.

Figure 1:
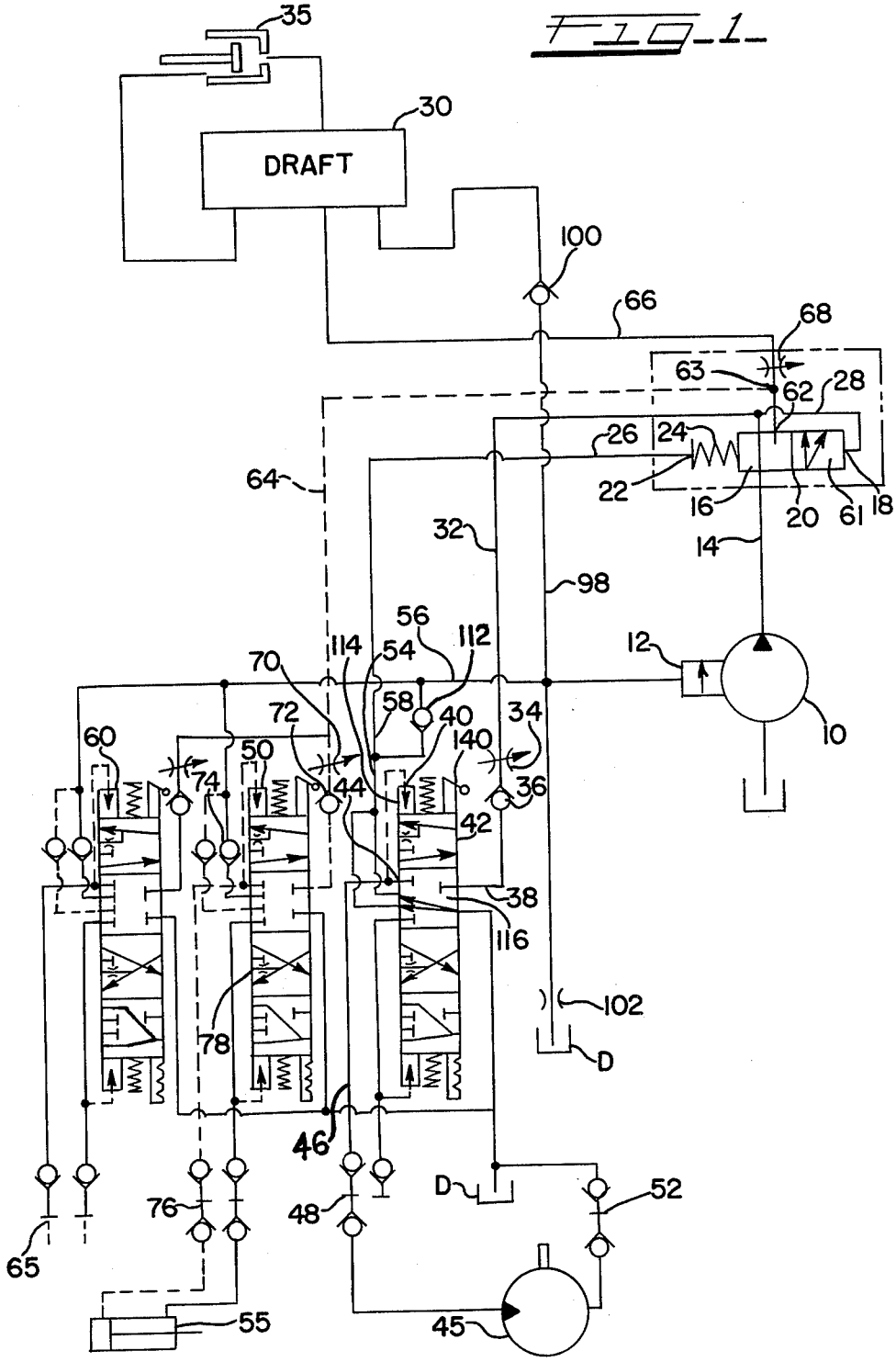
FIG. 1 is an hydraulic schematic diagram of my invention as shown embodied in a pressure-flow compensated system provided with a tandem connected priority valve, restricted orifice, and hydraulic unlatch primary valve.

More particularly, a system as shown in FIG. 1 of the drawings has major components which comprise: a pressure and flow compensated pump 10 of the variable displacement type as generally shown in U.S. Pat. No. 3,508,847; a two position priority valve 20; a first auxiliary load comprising a draft control valve 30 and a controlled single acting motor in the form of a draft setting, single acting hydraulic cylinder 35 or jack as used in an agricultural tractor hitch; another load which must have priority over the rest comprising a two position primary valve 40 and a one-way acting motor in the form of an hydraulic priority motor 45 suitable to drive at constant speed a planter fan, for example, as used in equipment drawn by the agricultural tractor and performing a seed planting operation therebehind; a further auxiliary load comprising a four position valve 50 and a controlled motor in the form of a double acting lift cylinder 55 suitable in a tractor hydraulic equipment system; and an additional auxiliary load comprising a four position valve 60 and a controlled motor load generally indicated by the unfinished outlet connections 65.

The pump 10, which can be a conventional axial piston variable displacement pump, draws from the reservoir and provides the system with fluid, to each of the loads 35, 45,55, and 65 as required. As a load requires more fluid because of encountering higher resistance and creating higher back pressure, the rise in pressure is communicated to a pump automatic control or compensator 12. The automatic control 12 compensates by increasing the pump output up to, at the extreme, the maximum pressure level of pump output. On the other hand, when there is decreased resistance of the load being supplied such as zero resistance, the pump 10 can go to a standby condition using little power and producing minor output as appropriately dicated by the pump automatic control 12.

All pump output is supplied through an output line 14 connected to the priority valve 20 which, in FIG. 1, is shown with its parts in the activated position 16. At that point, the priority valve parts are not moved out of their activated position by the control servo therefor because there is not enough force in one opposing pressure chamber 18 of the control servo. The reason is that the force is exceeded by force of pressure in one opposing pressure chamber 22 as augmented by a mechanical spring 24 tending to hold the valve in its activated position. A first sensing line 26 supplies pressure to the one of the opposing pressure chambers 22 and a second output-pressure-connected sensing line or communication 28 supplies pressure to the one opposing pressure chamber 18 of the control servo.

So, although the output pressure is being communicated through the second sensing line or communication 28, the entire pump output flows through only a priority load line 32 which includes a variably restricted orifice 34 and a check valve 36, connected in that order and located in the housing of the primary valve 40. The check valve 36 directly supplies the primary valve inlet 38.

Let it be assumed that the primary valve 40 under control of the tractor operator has been shifted with the parts taking their operating position 42. The entire fluid flow being pumped to the primary valve 40 leaves from the valve outlet 44 through the flow path 46 downstream, through a remote motor coupler 48, and passes through the constant speed hydraulic fan motor 45, from which it returns to drain D through another remote coupler 52.

In the operating position 42 of the primary valve parts, an internal downstream pressure sensing passage 54 which is open splits into a check valve controlled, compensator-connected line 56 and a priority connected line 58. The compensator-connected line 56 keeps the automatic control 12 of the pump 10 sensitive to downstream pressure in the priority path so that, as the pressure rises indicating more load resistance to the motor 45, the pump output pressure increases and keeps the motor 45 running at constant speed. Conversely, the pump automatic control 12 causes output pressure of the pump 10 to decrease when motor resistance decreases, and thus prevents overspeeding of the motor from the constant fan speed desired to be maintained.

The first sensing line 26 communicating with the priority connected line 58 and the second sensing line 28 for the priority valve 20 enable the opposing pressure chambers 22 and 18 of the control servo of the priority valve 20 to sense the pressure drop across the variably restricted orifice 34. The orifice 34 is adjusted so as to be satisfied when the motor 45 reaches the desired speed, and the amount of pressure drop selected may be 300 psi (2100 kPa), for example, as normal. Up until the orifice 34 is satisfied by sufficient flow therethrough, the pressure drop will be subnormal; therefore, downstream pressure communicated through the first sensing line 26 will have, in relative terms, a lower stage, high value holding the priority valve 20 so moved that the parts are in the activated position 16 supplying only the priority load of constant speed hydraulic motor 45. The check valve 36 prevents the motor 45 from reversing the flow coming from the pump 10 in case the priority load on the motor 45 suddenly rises to such a high overload value as to try to run the latter backwards as a pump, feeding back to pump 10.

The priority valve 20 enables the pump 10 to supply all or a lesser number of the auxiliary loads through the auxiliary valves 30 or 50 or 60 both when the priority load motor 45 has sufficient flow thereto or when it is stalled out or bottomed out. The priority valve 20 does so under the condition with its parts in the deactivated position indicated at 61. In this condition, pressure in the first sensing line 26 is relatively low because of the magnitude of pressure drop across satisfied orifice 34 being at normal or larger than normal value. Accordingly, the spring 24 of the priority valve 20 will be overcome and the valve 20 will shift because of the overpowering pressure in the one opposing chamber 18.

When so deactivated, the valve's auxiliary chamber 62 will receive a diverted part of the flow of pump 10, and the flow will split at 63 into an orifice-containing secondary flow line 64 and an orifice-containing auxiliary flow line 66. An auxiliary orifice 68 in the auxiliary flow line 66 is adjusted, for example, for a 300 psi (2100 kPa) drop which is so calibrated as to operate the single acting, hitch draft cylinder 35 at proper speed. So, while the priority load motor 45 is operating, the draft hitch control valve 30 will at the same time be operating the hitch cylinder 35 as allowed by the priority valve with its parts in the deactivated position 61. The draft hitch control valve 30 is shown by block diagram to have the relatively simplest form herein in that it exercises control over the pump automatic control or compensator 12 and no control over the priority valve 20.

Another auxiliary load constituted by the valve 50 and lift cylinder 55 is provided with an auxiliary orifice 70, a check valve 72, a compensator-connected check valve 74, and a remote coupler 76 to cylinder 55, all provided so similarly to the primary valve 40 already described as not to require elaboration except in two respects. First, the check valve 74 in conjunction with the check valve controlled, compensator-connected line 56 allows the former valve to open while the latter is closed to priority pressure and affords to the valve 50 independent pump control. That is to say, if the pump automatic control 12 is at the pressure set by the primary control valve 40 at a time when the orifice 70 and the auxiliary valve 50 require more flow for their load from the pump, then the line 56 will be pressurized through the unseating of check valve 74 at an increasing pressure so as to provide increasing excess flow available to the lift cylinder 55. Second, the lift cylinder 55 appears in the illustration as a double acting motor, and thus the auxiliary valve 50 can be operated so that its parts take a second operating position 78 to reverse the lift cylinder 55 in known way.

Again however, the auxiliary valve 50 has no control over the priority valve 20.

The further auxiliary load constituted by the valve 60 and by what may be, for instance, a single acting cylinder 65 is constructed, connected, and arranged so similarly to the valve 50 and its load 55 that individual description is believed unnecessary here.

PRIORITY VALVE DETAILS—FIG. 2

As previously described, the priority valve 20 is seen to have connections to the pump 10, the first auxiliary load valve 30, another load including the primary valve 40, a further auxiliary load valve 50, and the additional auxiliary load valve 60, and the same reference numerals are used as in the previous description. Entering flow from the pump and line 14 passes leftwardly and upwardly in a direction according to a solid line arrow as viewed in FIG. 2 so that, when the valve parts occupy the activated position as shown in solid lines at 16, the flow continues through an open valve port 80 and follows the path indicated by solid arrows out through the priority flow line 32. Upstream pressure as sensed from the variably restricted orifice 34 in the priority path communicates through the valve spool slot communication 28 with the pressure inside one opposing chamber 18 of the priority valve servo control; this pressure however, in the activated valve position 16 as shown is unable to overcome the pressure within the opposing chamber 22 as augmented by the spring 24. On the other hand as pressure in the first sensing line 26 rises to the lower stage, high pressure value described, the priority valve parts take a deactivated position such as the one shown by the broken lines 61 (FIG. 1), causing a spool relief to take the position as shown by broken lines 82, still allowing priority flow to follow the broken line arrows indicated so as to satisfy the priority load 45.

At the same time, another spool relief takes the position as shown by the broken lines 84 opening a port 86 which feeds excess flow into the auxiliary outlet chamber 62 of the priority valve 20. Flow in one path from the relief 84 follows the broken line arrows upwardly as viewed in FIG. 2 through the auxiliary chamber 62 and supplies the secondary flow line 64 which divides up the flow to be consumed between the further auxiliary load valve 50 and the additional auxiliary load valve 60.

Figure 2:
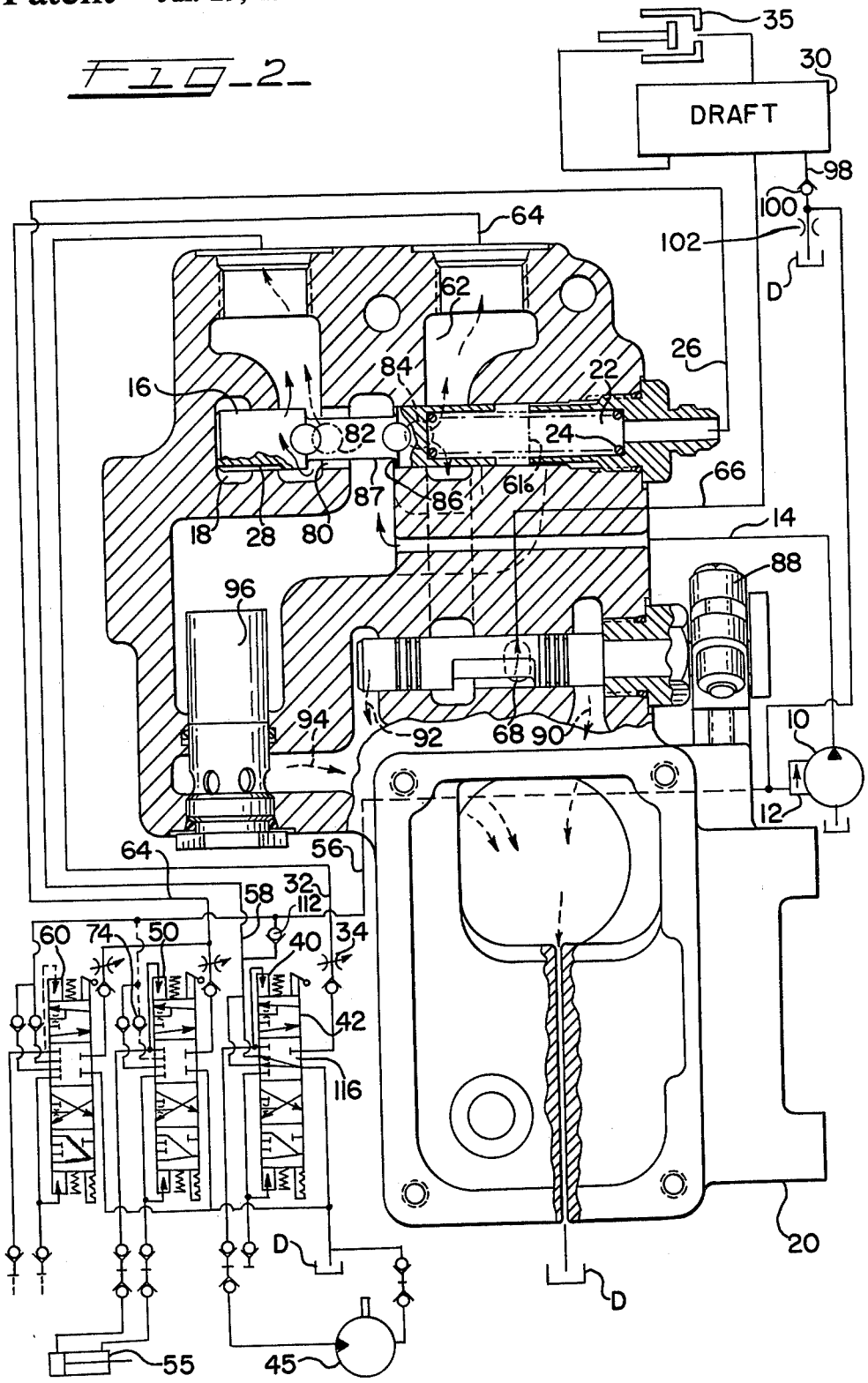
FIG. 2 is a similar showing of the system of FIG. 1, but with the priority valve shown to enlarged scale and in cross section.

Simultaneously, the spool relief 84 also supplies flow through the chamber 62 in the direction of the broken line arrows downwardly as viewed in FIG. 2 so as to pass through the draft load variably restricted orifice 68 and upwardly as viewed in the drawing according to the broken line arrow, through the auxiliary flow line 66 to the first auxiliary load valve 30. The orifice adjustment is made and is fixed by means of an adjustable stop and a set screw clamp 88 providing for resettable, rotatable adjustment in the restriction. A drain D receives internal leakage from the valve which follows the broken line arrows 90 and 92, and also a broken line arrow 94 from a relief valve 96 provided for the auxiliary flow paths.

An overtravel or extreme deactivated position of the parts as indicated by the broken lines **61*o* (FIG. 2) and the opposite position indicated by the solid lines 16 define the limits between which the valve parts make an infinity of adjustments for accurately diverting flow as the opposing pressure chambers 18 and 22 sense variations of pressure drop across the orifice at 34**.

The compensated-pump-controlling draft valve 30 will be seen to have a drain-connected line 98 controlled for restricted bleed-down by a check valve 100 and by a restriction 102 leading to the drain D.

In a more detailed cycle of operation, when movement of the primary valve places the valve parts in a neutral position 116 as shown in FIG. 2, all flow is blocked in the priority load line 32; pressure supplied to the check-valve controlled, compensator-connected line 56 is discontinued by the valve 40 which is connected to drain D, causing the pump 10 to shift appropriately for standby as long as no flow is needed. No flow means no pressure differential, and so the unopposed spring 24 maintains the priority valve parts in the activated position 16 with an annular spool groove 87 astraddle of the port 80 to the priority path but blocked from the port 86 and auxiliary chamber 62.

Gradual shift of the primary valve 40 moving the parts toward the operating position 42 affords increasing flow in the orifice 34, causing increasing pressure differential between the orifice's upstream and downstream sides and between the opposing chambers 18 and 22, and causing automatic shift of the priority valve parts, from their position 16 toward the right as viewed in FIG. 2 thus opening the auxiliary flow path as the annular spool groove 87 opens through one spool relief in position 84 into the auxiliary chamber 62. If the priority flow becomes excessive through the orifice 34, such as could be occasioned if the orifice 34 were supplying a reel motor priority load which had transiently gone into an overspeed condition, further shift of the aforesaid priority valve automatically toward the right forces the other spool relief further rightwardly from its position as shown by the broken lines 82, metering and restricting priority flow.

Extreme overspeeding causes the priority valve 20 to have its parts overtravel to the extreme deactivated position **61*o* (FIG. 2), altogether blocking off the port 80 and the last mentioned spool relief and stopping priority flow. Other movements can be readily visualized under various operating conditions encountered, prior to shut down time in the cycle of the equipment, at which time the parts of the valves 20 and 40 are restored to, respectively, the activated position 16 and neutral position 116**.

The cycle is then repeated.

In one physically constructed embodiment of the invention the pump 10 was arranged to have a maximum pressure setting of 2600–2700 psi (18,000 kPa–19,000 kPa) in the pump automatic control or compensator 12. Relief valving, not shown, was provided in the system set to relieve pressure in the range 2800–2850 psi (19,000–20,000 kPa.

PRIMARY VALVE PRIORITY FLOW—FIG. 3

When the two-position priority valve 20 has its parts in either of the two positions 16 and **61*o* and also in positions (e.g., position 61, FIG. 1) intermediate thereto for closer regulation, the priority load line 32 is constantly controlled for making available the supply from the pump 10 to the primary valve 40. The same as previously described, the parts of the valve 40 cause the operation as before and the same reference numerals are used as in the previous description. A lock nut 104 on valve 40 sets the variably restricted orifice 34 in a rotatably fixed position as calibrated for receiving the priority flow from the load line 32**.

Figure 3:
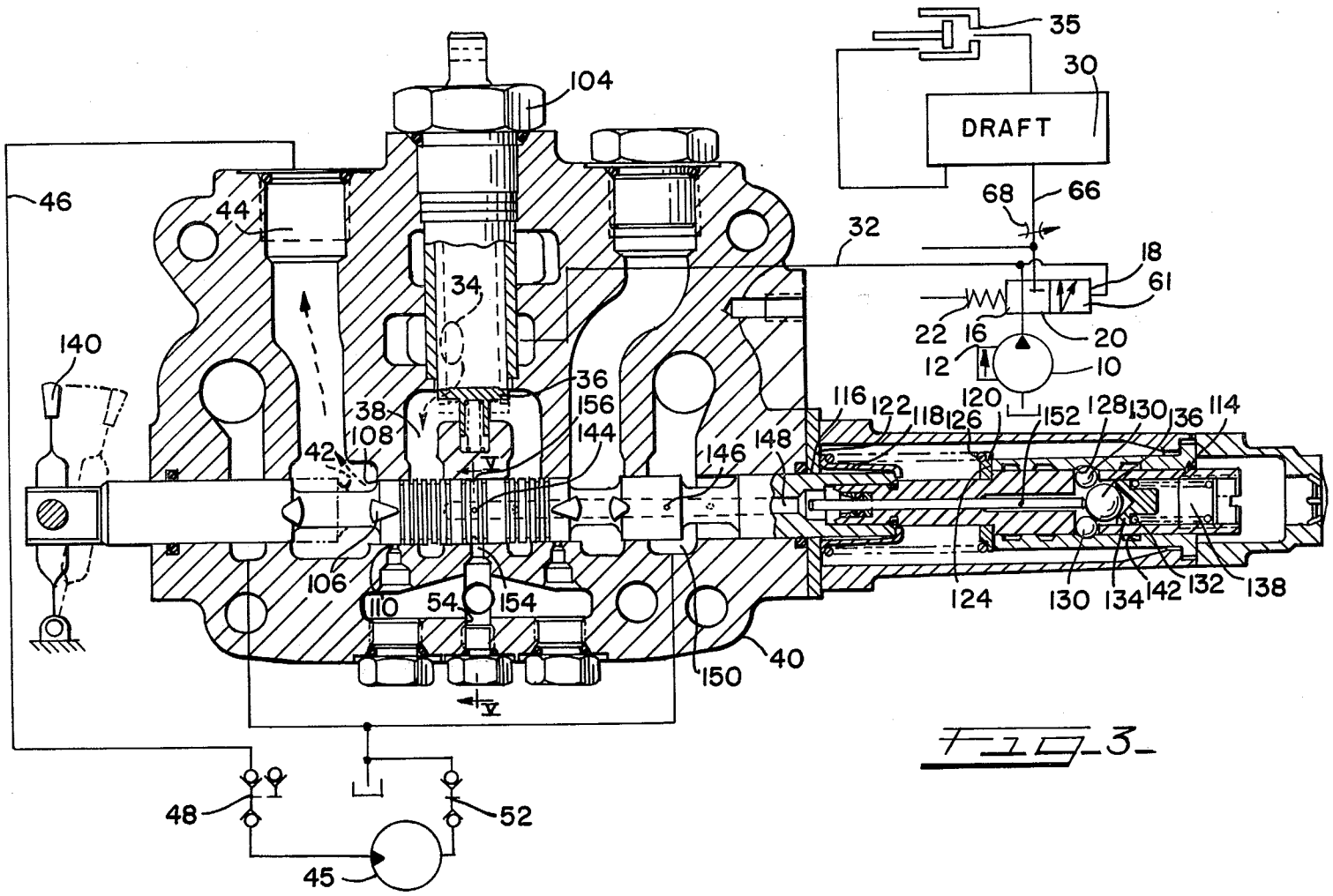
FIG. 3 is a similar showing of the system of FIG. 1 but with the orifice and the centered hydraulic unlatch primary valve shown to enlarged scale and in cross section.

Therefore when the valve 40 has the parts in operating position as shown by the broken lines 42, appearing in FIG. 3, flow from the orifice 34 follows the broken line arrow which is downwardly directed as viewed in FIG. 3 so as to unseat the check valve 36 and enter the primary valve inlet 38. A valve spool relief 106 and a reduced spool diameter provide the communication from the inlet 38 through a valve port 108 to allow flow to follow in the path of the broken line arrows which are upwardly directed as seen in FIG. 3, to flow from the valve outlet 44 to the priority load as constituted by the constant speed hydraulic motor 45.

Simultaneously through the open port 108 in the primary valve 40, a pickoff hole 110 communicates the downstream pressure to the downstream passage 54 for the control purposes described. More particularly, as seen in FIG. 3 and especially in FIG. 5, the fluid has a split in the flow from the downstream passage 54 and enters one opposing chamber 22 of the priority valve control servo through the priority-connected line 58 and first sensing line 26 in that order. The split flow from the downstream passage 54 also is communicated to the pump automatic control or compensator 12 through the compensator-connected line 56 as controlled by a check valve 112.

Decreasing pressure in the downstream passage 54 can be caused by a condition of lessening of the resistance encountered by the priority load, and the meaning of the condition is that priority valve 20 at the time has an excess of flow to be made available as secondary flow and also that the demand on the pump 10 can be lessened. The decrease at 54 is therefore reflected by low pressure in the pump compensator 12 to reduce pump stroke, and by low pressure in the control servo of the priority valve 20 so that the parts take the deactivated position (61, FIG. 5) providing for auxiliary flow.

On the other hand, increasing pressure in the downstream passage 54 can be caused by increasing resistance encountered by the priority load, either slowing down the speed of the load or else stopping it by stall-out or bottoming-out. But slowing down produces a high pressure at 54 signifying one thing for the pump 10 and priority valve 20 to do, whereas stall-out produces a high pressure calling for an altogether different appropriate thing for the pump and priority valve to do.

LOWER STAGE, HIGH PRESSURE—FIGS. 3 AND 5

Increased pressure can mean the priority load needs to be speeded back to the constant speed desired, and such increase in pressure at 54 is reflected by consequent lower stage, high pressure in the pump compensator 12 to increase pump stroke and output pressure level, and by similar high pressure in the control servo opposing chamber 22 to activate the valve 20 and cause the priority load to monopolize all or most all of the pump output until the constant speed desired is reachieved. The pump stroke regulation is automatic in response both to decreasing pressure at 54 and increasing pressure at 54.

UPPER STAGE, HIGH PRESSURE—FIGS. 3 AND 5

This pressure condition problem would, without solution, force the priority valve 20 to take, or keep, the activated position of its parts and reserve all pump pressure for the stalled-out priority motor load 45. The auxiliary circuits would have enforced idleness, an undesirable situation, all because of the zero flow in the variably restricted priority path orifice 34; such zero flow would allow the downstream passage 54 to increase under a pressure matching upstream pressure, thus equalizing pressures in the control servo opposing chambers 22 and 18 for an enforced parts setting at the position 16 in priority valve 20.

Means is provided herein, as applied to the detented two-position primary valve 40, affording a novel one-two-three interaction among the orifice 34 of valve 40, the detented spool element of valve 40, and the priority valve 20 which, without such means would shut down the entire tractor hydraulic system as disclosed when the priority load 45 stalls-out.

HYDRAULIC UNLATCH—FIGS. 3 AND 4

Such means is ilustrated in these figures in the form of hydraulic unlatch mechanism 114 of the type generally as shown in U.S. Pat. No. 2,532,552, No. 2,757,641, No. 2,848,041, and No. 3,128,677.

From the operating position 42 of the cannelured movable parts of the primary valve 40, resetting of the valve causes the parts to take a neutral position as indicated at 116. Neutral is an enforced re-centered position because of two spring seats 118 and 120 carried by the movable parts of mechanism 114, which seats are disengageably bottomed against stops 122 and 124, and are constantly urged apart by a single valve recentering spring 126. Neutral is a latched position by reason of a latching pocket 128 in the stop 124 removably receiving radially acting ball detents 130 in the movable valve parts. A spring 132 constantly biases a ball seat 134 and a latching ball 136 relative to a stop 138 in a direction leftwardly as viewed in FIGS. 3 and 4. The latching ball 136 in turn engages the ball detents 130 at a diagonal angle urging them radially outward to their seated or latched position in the latching pocket 128.

Figure 4:
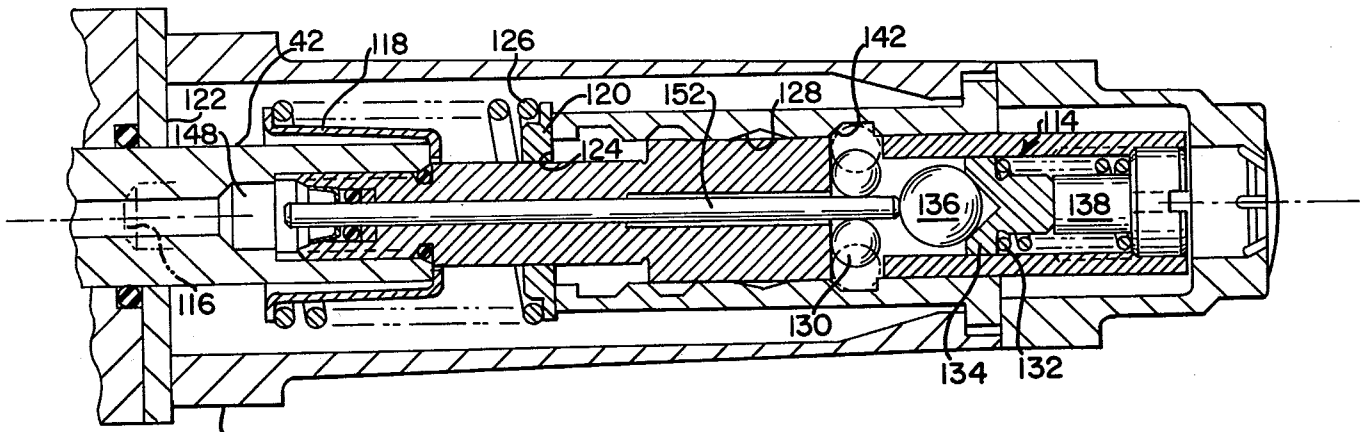
FIG. 4 is a similar showing of the primary valve of FIG. 3, but shown in fragmentary view and with the valve parts concerned shown in an operating position in the valve.

By moving a valve lever 140 to the right as viewed in FIG. 3, the operator can overcome spring 126 by separating the seat 118 from the stop 122 and wedging the ball detents 130 from their neutral latching pocket radially inwardly against the bias of the spring 132. The operating position is achieved when the ball detents 130 take the broken line position as shown in FIG. 4 removably occupying an operating position latching pocket 142. The spring 132 and latching ball 136 have a mechanical advantage in the operating position of the valve 40 so that the ball detents prevail over the bias of the partially compressed recentering spring 126.

In operating position of the hollow movable parts of primary valve 40, a pair of intercommunicating unlatch or neutral dump ports 144 and 146 take corresponding transposed positions as shown by broken lines in FIG. 3, one connecting an axial passage 148 to the primary valve inlet 38 and the other blocking off the passage 148 from side-venting into a valve drain outlet 150. So in the valve operating position, the primary valve inlet pressure is constantly communicated in the hollow interior through the passage 148 to one end of a piston rod plunger 152 having the other end axially engaged with the latching ball 136.

Hydraulic pressure on the plunger 152 as it rises to upper stage, high level pressure causes the plunger 152 to collapse the spring 132 and, relative to the space between the ball detents 130, thereby supplanting in that space the large diameter latching ball 136 with the small rod size of the plunger 152.

The unopposed recentering spring 126 will therefore wedge the ball detents (FIG. 4) from their broken line position into the retracted, solid line position shown, automatically resetting the unlatched movable parts of valve 140 to neutral position.

RESET PRIMARY VALVE POSITION—FIG. 3

Figure 5:
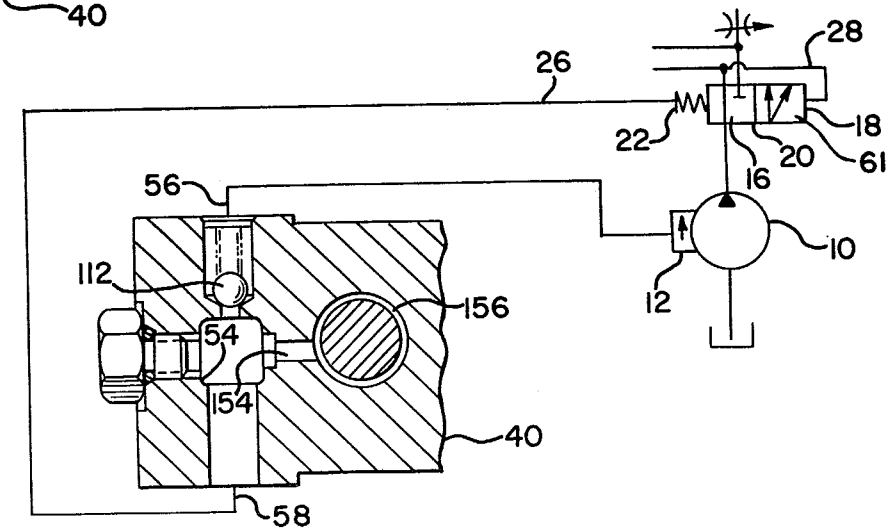
FIG. 5 is a transverse view taken along the section line V—V of FIG. 3, so as to present a fragmentary showing; of the primary valve.
Figure 6:
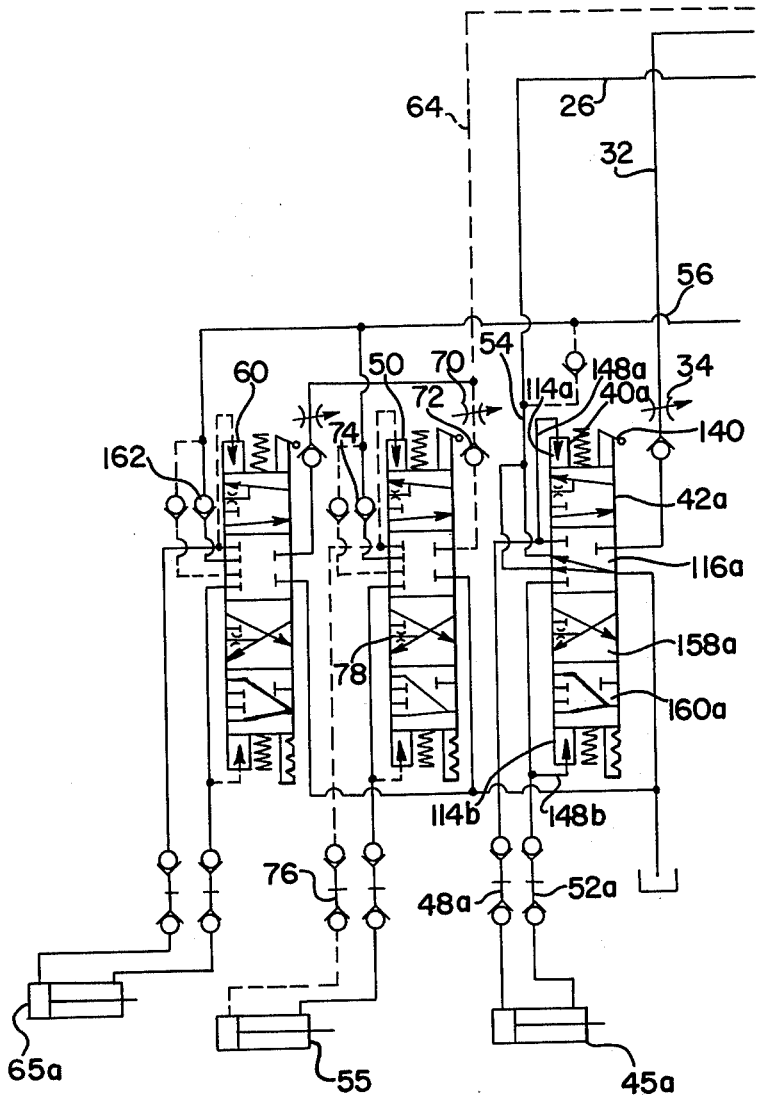
FIG. 6 is a hydraulic schematic diagram similar to FIG. 1 but showing a modified form of my system.

In reset position 116 of the movable parts of valve 40, three circuits are automatically switched so as to be disconnected and reconnected to drain. The first circuit comprising the unlatch port 146, the passage 148, and the unlatch port 144 is connected by the first named port 146 to the valve drain outlet 150 thereby dumping to drain the unlatching pressure on the piston rod plunger 152 so that automatic detenting will occur in the valve 40. Second, the circuit consisting of the opposing pressure chamber 22, first sensing line 26, the priority-connected line 58 (FIG. 5), the downstream passage 54, a pickoff hole 154, circumferential spool grooves 156, unlatch port 144, passage 148, and the unlatch port 146 is connected by the latter to the valve drain outlet so as to vent to drain one opposing chamber of the control servo of the priority valve 20 (FIG. 5).

Third, the circuit of the pump compensator 12, the compensator-connected line 56, and the seated check valve 112 (FIG. 5) is connected by the unlatch port 146 to the valve drain outlet 150 in a path including the downstream passage 54, pickoff hole 154, circular spool grooves 156, unlatch port 144, passage 148, and the said unlatch port 146, preventing any further operating pressure from the priority load to influence the pump 10 or cause it to labor.

Finally, and equally significantly, the valve 40 with its parts reset in neutral position shuts off the primary valve inlet 38 from the priority path 44, 46 and 48 leading to the stalled-out motor 45. That is to say, the high pressure demanding, stalled-out priority motor 45 is off the line and hydraulically locked against reversal, the priority valve 20 in overtravel position 61o blocks priority load line 32 to keep motor 45 off the line and hydraulically locked against reversal; and valve 20 stays deactivated to serve the auxiliary loads, the auxiliary loads are freely fed on the line and the pump 10 is free to feed them, the pump 10 is completely unburdened from the load of the stalled-out priority load 45, the pump compensator 12 is under control of the auxiliary loads and is free from any demand signal of the priority load, and the automatic unlatch mechanism is depressurized so that the primary valve 40 holds itself recentered and detented in the neutral position desired.

DOUBLE ACTING LOAD—FIG. 6

This figure shows the ready application of my invention to a double acting priority load cylinder **45*a* and to double acting auxiliary load cylinders 55 and 65*a*. A four-position primary motor valve 40*a* is preferably having, in addition to the neutral position 116*a* of its parts and the operating position 42*a*, a motor reversing operating position 158*a* and a float position 160*a* of its parts. Also, passages 148*a* and 148*b* as provided, operate the automatic detent unlatch mechanisms 114*a* and 114*b* individually in both operating positions 42*a* and 158*a*** of the valve parts.

Similarly to the check-valve controlled, compensator-connected line 56 supplied from the downstream passage of the primary motor valve **40*a*, the further auxiliary valve 50 has a check valve 74 to communicate downstream pressure to the compensator-connected line 56 and the additional auxiliary valve 60 has a check valve 162 connected to deliver downstream pressure to the line 56; also similarly to the primary valve 40*a*, the further auxiliary valve 50 and additional auxiliary valve 60 have, as illustrated, the same four positions including float and the same hydraulic unlatch mechanism effective in each of the two operating positions of the valve 50 and the valve 60**.

In operation, if only the primary valve 40 has the parts in operating position and the priority load cylinder **45*a*** bottoms or stalls out, the pump, not shown, automatically goes to standby pressure for the reasons described.

If the parts of the primary valve **40*a* and further auxiliary valve 50 are in operating position when the priority load 45*a* stalls out or bottoms out, all flow of the pump, not shown, is diverted by the priority valve, not shown, through the valve 50 to the further auxiliary load 55 until the latter stalls or bottoms out; thereupon the valve 50 automatically hydraulically unlatches and resets to neutral position so that the pump goes under standby pressure in its operation and the unopposed spring 24 (FIG. 2) restores the parts of the priority valve 20 to active position 16** as shown by solid lines.

Finally, if the auxiliary valves 50 and 60 are the ones with the parts in operating position, the load 55 or **65*a* whichever offers the least resistance will keep moving causing its cylinder stroke to be completed, whereupon the cylinder stroke of the other auxiliary load will be completed. At that point with both cylinders bottomed out, the downstream pressure will rise and cause both valves 50 and 60** to automatically hydraulically unlatch, returning to neutral and restoring the pump, not shown, to standby pressure in its operation.

From the foregoing, and by way of the example of valve 60 and valve **40*a* being in simultaneous operation when valve 60's load completes its stroke and bottoms out, followed by valve 40*a*'s load completing its stroke and bottoming out, it will be apparent that the operator's attention is not required. In other words, he sets the appropriate valve handles such as valve handle 140** in operating position and turns his attention to other tractor operations, knowing that when the hydraulic load work is completed the valves will reset themselves to neutral automatically.

Three of the salient features hereof are the sensitivity of the priority path orifice 34 to stall-out pressure drop (actually, lack of drop of pressure across the orifice) which is then signalled to the closed center spool type primary valve 40; the sensitivity of the primary valve 40 to the stall-out pressure as signalled, which is then communicated as a deactivating pressure signal by venting the priority valve servo control to drain; and the sensitivity of the priority valve 20 to the deactivating signal as communicated, so as automatically to accept the pump flow available and fully divert it to the auxiliary circuits. For optimum benefit and efficiency in the sequence, the connection 56 is necessary between the closed center primary valve 40, **40*a* and the pump compensator 12 whereby the valve 40, 40*a* can operate to switch the connection 56 to drain D to rid the pump from any false demand originating from the stalled-out priority load motor 45, 45*a*; the connecting line 48, 48*a*, 52, 52*a* is necessary between the closed center primary valve 40, 40*a* and priority load motor 45, 45*a* whereby the valve blocks the latter off the line so that, if loaded, the priority motor will not further burden the pump output and is hydraulically blocked from the pump line so that it cannot reverse flow in case an overpowering load has a tendency to reverse the motor 45; and the connection 146 is necessary between the hydraulic unlatch mechanism 114, 114*a*, 114*b* and the closed center spool type primary valve 40, 40*a*** which latter when neutralized as shown in FIG. 3 deactivates hydraulic unlatching and restores the automatic detenting action of the hydraulic unlatch mechanism 114.

As herein disclosed, my hydraulic system invention is shown applied to tractor drawn planter equipment hitched to an hydraulically equipped farm tractor wherein the priority load is a planter fan, not shown, used to propel seed, and the auxiliary loads consist of the hydraulic hitch to the drawn equipment and various operating cylinders such as hydraulic lift cylinders provided on the tractor. It is evident that other tractor drawn equipment will find equal utility for my invention, such as a drawn raker whereof a raker sprayer provided thereon is driven at constant speed as the priority load to propel crop spray. So also the disclosure describes the constant speed type priority load in a tractor hydraulic system, but the invention is equally adaptable to other priority loads in tractor systems such as the power steering load which requires precedence over secondary circuits, and the invention is likewise adaptable to various priority loads in systems with primary and secondary circuits, both for tractor hydraulic applications and other hydraulic applications in no way concerned with hydraulic tractors.

Variations within the spirit and scope of the invention described are equally comprehended by the foregoing description.

What is claimed is:

1. For use in a pressure-flow compensated circuit path in combination with a restricted orifice (34) providing downstream pressure in a flow supply line included in said path and leading from the restricted orifice to a downstream priority load (45,45*a*):

a priority valve (20) upstream in said path provided with opposing servo chamber means for sensing the pressure drop across the posterior restricted orifice, and servo positioned thereby in an activated position for cutting off an auxiliary flow to an auxiliary motor load (35,55,65,65*a*) and continuing to supply the restricted orifice and line therefrom to the priority load when the downstream pressure is at a lower stage high pressure, and alternatively for being deactivated and opening the auxiliary flow to the auxiliary motor load whenever pressure to the opposing servo chamber means is deactivated; and control means (40,40*a*) sensitive to downstream pressure hydraulically disposed in said line and connected and arranged in response to a sensed upper stage high pressure to deactivate the servo chamber means and priority valve by disconnecting the opposing servo chamber means from the downstream pressure and venting the opposing servo chamber means by reconnecting same to drain.

2. For use in a pressure-flow compensated system in combination with a restricted orifice supplying a line to a downstream priority load:

a priority valve arranged with opposing servo chamber means which through a pair of signal lines senses the pressure drop across the restricted orifice, and connected and arranged when servo positioned in an activated position thereof by the pressurized opposing chamber means to cut off an auxiliary flow to an auxiliary motor load and continue to supply the restricted orifice and line therefrom to the priority load, said priority valve having a servo deactivated position connected for opening the auxiliary flow to the auxiliary motor load when one of the pair of signal lines is deactivated by venting same;

a positionable primary control valve connected in the supply line for controlling the fluid flow supply to the priority load and for connecting the one signal line of the opposing chamber means to the pressure downstream of the restricted orifice, all in a detented, set operating position of the control valve; and hydraulic control valve detent unlatch mechanism responsive to pressure, and connected to downstream pressure by the control valve in its operating position for causing the latter automatically to unlatch under high downstream pressure and to deactivate the one said signal line and priority valve by disconnecting the one signal line of the opposing chamber means from the downstream pressure and reconnecting the one signal line to drain to vent the opposing chamber means, all in a neutral position of the control valve to which it is automatically reset from the set operating position when the detent is hydraulically unlatched.

3. In an hydraulic circuit having a variable displacement automatically controlled pump for supplying a priority flow path and at least one auxiliary motor, a restricted orifice hydraulically disposed in the priority flow path and presenting an upstream side to the flow and a downstream side whence the flow continues to the priority load, a priority valve and a priority load-supplying, primary flow valve connected in said priority flow path in tandem with the restricted orifice and with the priority valve on the upstream side and the primary flow valve on the downstream side, said priority valve provided with a control servo having opposing first and second chambers for controlling said priority valve and further provided with an auxiliary outlet chamber connected to the auxiliary motor, a first sensing line leading to the first opposing chamber of the control servo and to the automatic control of the pump, a second sensing line leading to the second chamber, the priority valve having a first position blocking the auxiliary outlet chamber and flow to the auxiliary motor while opening the priority flow path to the priority flow-supplying primary flow valve when the flow is stopped (because of load stall-out) or is insufficient to the priority load, the priority valve having a second position opening the auxiliary outlet chamber and flow to the auxiliary motor when the fluid pressure force in said second chamber exceeds the total force exerted in the opposing first chamber, the primary valve being detented when set from neutral into an operating position opening the downstream flow path to the priority load, the improvement comprising:

means included in the primary valve effective only in the operating position of the latter for connecting the first sensing line to the pressure downstream of the restricted orifice thus to apply pressure to the automatic control of the pump and to the first chamber for opposing the fluid pressure force aforesaid in the second chamber, means for connecting the second sensing line to the pressure upstream of the restricted orifice to generate said fluid pressure force in the second chamber, and means providing, for the primary valve, an hydraulic detent unlatch connected thereby to the downstream pressure when the primary valve is set in the operating position and responsive to elevated downstream pressure because of load stall-out to reset the primary valve in neutral position.

4. In an hydraulic circuit having a variable displacement automatically controlled pump for supplying a priority flow path and at least one auxiliary motor, a priority valve in the priority flow path having a downstream side whence the flow continues to the priority load, a priority valve control servo having opposing chamber means for controlling said priority valve, a priority valve auxiliary outlet chamber connected to the auxiliary motor, the control servo opposing chamber means for the priority valve being signal responsive for positioning same in an activated position blocking the auxiliary outlet chamber and the flow to the auxiliary motor while opening the priority flow path to load when flow is stopped (because of load stall-out) or insufficient to the priority load, and in a deactivated position opening the auxiliary outlet chamber and flow to the auxiliary motor after priority load flow is sufficient, the improvement comprising:

signal generating means effective to apply pressure-flow, first and second deactivating signals to the priority valve so as to supply the auxiliary motor when the priority load respectively, firstly, is stalled-out and, secondly, has available flow in excess of supply sufficient for itself, and a pressure-flow activating signal to the priority valve so as to supply solely the priority load when the supply therefor is no more than sufficient;

said signal generating means comprising a separate restricted orifice and primary control valve, the two of which are tandem connected in that order in the flow path downstream between the priority valve and the priority load, and which are effective in a neutral reset position of the primary valve to send the first deactivating signal to the priority valve by venting to drain said priority valve chamber means, and the two of which are effective when the primary valve is set from neutral into an operating position to send the second deactivating signal to the priority valve when flow through the orifice has a substantial pressure drop thereacross and to send the activating signal to the priority valve when flow through the orifice has a reduced pressure drop thereacross signalling no more than sufficient flow available to the priority load.

5. In an hydraulic circuit having a variable displacement automatically controlled pump (10) for supplying a priority flow path (32) and at least one auxiliary motor, and a restricted orifice (34) hydraulically disposed in the priority flow path and presenting an upstream side to the flow and a downstream side whence the flow continues to the priority load, the improved arrangement of a priority valve (20) and a priority load-supplying, primary flow valve (40, 40*a*) connected in said priority flow path in tandem with the restricted orifice and with the priority valve on the upstream side and the primary flow valve on the downstream side, said improved arrangement including:

a priority valve control servo (16, 61) having opposing first and second chambers (18, 22) for controlling said priority valve;

a priority valve auxiliary outlet chamber (62) connected to the auxiliary motor;

a downstream sensing line (54, 56, 58, 26) for connecting the first opposing chamber (22) of the control servo to the pressure downstream of the restricted orifice and to the automatic control (12) of the pump;

an upstream sensing line (28) connecting the second chamber (18) to the pressure upstream of the restricted orifice;

the priority valve having a first position (16) blocking the auxiliary outlet chamber and the flow to the auxiliary motor (35, 45, 45*a*, 55, 65, 65*a*) while opening the priority flow path to the priority, load-suppling, primary flow valve when flow is stopped (because of load stall-out) or insufficient to the priority load, the priority valve having a second position (61) opening the auxiliary outlet chamber (62) and flow to the auxiliary motor when the fluid pressure force in said second chamber connected to the upstream sensing line exceeds the total force exerted in the opposing first chamber connected to the downstream sensing line;

the primary valve (40, 40*a*) being detented (130) when set from neutral (116, 116*a*) into an operating position (42, 42*a*, 158*a*) both opening the downstream flow path to the priority load, and also opening the downstream pressure to the downstream sensing line and to the automatic control (12) of the pump and to the first chamber (22) for opposing the fluid pressure force as aforesaid in the second chamber, the primary valve having an hydraulic detent unlatch (136, 152) connected thereby to the downstream pressure when the primary valve is set in the operating position (42, 42*a*, 158*a*) and responsive to elevated downstream pressure because of load stall-out to reset the primary valve to its neutral position, venting to drain the downstream sensing line and the first chamber, whereby introduction of downstream pressure to the pump automatic control ceases and the fluid pressure force in the second chamber resets and/or holds the priority valve in the second position (61) by overcoming the total force exerted in the first chamber (22) of the servo control.

6. The invention of claims 2, 3, 4, or 5, wherein the primary valve is a closed center control valve effectively blocking in neutral position (116, 116*a*) all flow to and from the priority load so as to unburden the pump.

7. In an hydraulic circuit having a variable displacement automatically controlled pump for supplying a priority load flow path and at least one auxiliary motor with fluid, a priority valve in the pump output provided with control servo opposing pressure chamber means for controlling said priority valve and further provided with an auxiliary outlet chamber connected to the auxiliary motor, and a first sensing line connected to the chamber means of the control servo and to the automatic control of the pump, the priority valve having an activated position in response to activating pressure in the chamber means blocking the auxiliary outlet chamber and flow to the auxiliary motor while opening the line to the priority flow path, the priority valve having a deactivated position in response to less than activating pressure for opening the auxiliary outlet chamber and flow to the auxiliary motor, a restricted orifice having an upstream side connected in the output of the priority valve and providing downstream pressure flow for the priority load flow path, and a load line control connected between the orifice and priority load in said priority load flow path and movable between an operating position and a center dump neutral position, and having a drain connection (D), characterized in that means is included in the load line control (40, 40*a*) comprising:

1st valve passage means (106, 110) effective only in the operating position of the control for connecting the first sensing line to the pressure downstream of the restricted orifice thus to apply controlling pressure to the automatic control of the pump and activating pressure to the control servo opposing chamber means;

2nd valve passage means (38, 106, 44) effective only in the operating position of the control for opening the downstream flow path of the fluid supply to the priority load (45, 45*a*); and disconnecting means (152, 126, 148, 146, 108) hydraulically associated with the 1st and 2nd valve passage means and with the drain, and having a pressure movable area (152) responsive to high downstream pressure to cause the control to move from the operating position to neutral in which neutral position of the control both the priority load and fluid supply thereto are blocked off thereby, in which neutral position of the control the first sensing line is disconnected from the downstream pressure and reconnected to drain thereby, and in which neutral position of the control the pressure movable area is disconnected from the downstream pressure and reconnected to drain thereby.

8. Method of operating a pressure-flow compensated priority system so as to discriminate among the conditions of a stalled-out priority load requiring blockage of the flow path thereto, the flow condition of the priority load with above-ample flow available for it in the flow path thereto, and the flow condition of the priority load with no-more-than ample flow available, said system comprising a signal responsive priority valve in the flow path having an auxiliary motor load chamber and having deactivated and activated positions to open and cut off, respectively, the chamber to the auxiliary motor load so as to supply either or both loads depending upon requirement conditions of the priority load, said method comprising the steps of:

generating for priority deactivation purposes a first signal at drain stage pressure and a second signal at a low pressure, and for activation purposes a third signal at a high pressure; and applying the first signal so as to deactivate the priority valve under drain stage pressure as result of priority load stall-out, the second signal so as to deactivate the priority valve under low pressure as result of more than ample flow available to the priority load, and the third signal to activate the priority valve under high pressure as result of available flow to the priority load being no more than ample.

9. In an hydraulic circuit having a variable displacement automatically controlled pump for supplying a priority-load-connected priority flow path and at least one auxiliary motor load, the combination, with the automatic control of the pump and with said priority flow path, of:

a priority valve (20) connected therein having control servo opposing chamber means for controlling said priority valve, and further having an auxiliary outlet chamber for connection to the auxiliary motor load, and yet further having a sensing line (54) connected to the chamber means of the control servo and to the automatic control of the pump, said priority valve selectively supplying either or both loads in positions taken including an activated position taken by the priority valve in response to activating lower stage, high pressure in the chamber means so as to block the auxiliary outlet chamber and flow to the auxiliary motor load while opening the output to the priority flow path and flow to the priority load, a fully deactivating, blocking position taken in response to drain pressure in the chamber means so as to block the priority flow path and flow to the priority load while opening the auxiliary outlet chamber and flow to the auxiliary motor load, and a joint flow deactivating position taken in response to low pressure in the chamber means so as to supply both loads by opening the priority flow path and at least partially opening the auxiliary outlet chamber;

a restricted orifice (34) connected in the priority flow path having an upstream side connected in said output of the priority valve and providing downstream pressure flow for the priority load flow path;

a load line valve control (40) connected in said priority load flow path so as to intervene downstream of the orifice but ahead of the priority load, and movable between an operating position and a centered dump position;

means included in the load line control comprising:

a drain connection (D);

1st valve passage means (106,110) effective in the operating position of the control for connecting the sensing line to the pressure downstream of the restricted orifice thus to apply controlling pressure to the automatic control of the pump and activating pressure to the control servo opposing chamber means;

2d valve passage means effective only in the operating position of the control for forcing the fluid supply to be directed under pressure to flow from the downstream flow path to the priority load; and disconnecting means (152, 126, 148, 146) hydraulically associated with the 1st and 2nd valve passage means and with the drain (D), and having a pressure movable area (152) responsive to upper stage, high downstream pressure to cause the control to move from the operating position, so as to center in the dump position in which the sensing line and the pressure movable area are disconnected from the downstream pressure and reconnected to drain thereby, whereby the priority valve takes its blocking position in the priority flow path with the priority load and fluid supply thereto blocked off.

* * * * *